US007417597B1

(12) United States Patent
Lopez

(10) Patent No.: US 7,417,597 B1
(45) Date of Patent: Aug. 26, 2008

(54) GPS ANTENNA SYSTEMS AND METHODS WITH VERTICALLY-STEERABLE NULL FOR INTERFERENCE SUPPRESSION

(75) Inventor: Alfred R. Lopez, Commack, NY (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 18 days.

(21) Appl. No.: 11/708,309

(22) Filed: Feb. 20, 2007

(51) Int. Cl.
*H01Q 21/20* (2006.01)
*H01Q 21/26* (2006.01)
*H01Q 9/34* (2006.01)

(52) U.S. Cl. ..... 343/799; 343/798; 343/874

(58) Field of Classification Search ..... 343/798, 343/799, 814, 874, 878, 891
See application file for complete search history.

(56) References Cited

U.S. PATENT DOCUMENTS 5,264,862 A * 11/1993 Kumpfbeck ..... 343/853
5,534,882 A * 7/1996 Lopez ..... 343/891
6,201,510 B1 * 3/2001 Lopez et al. ..... 343/799
2008/0036683 A1 * 2/2008 Schadler ..... 343/878

* cited by examiner

*Primary Examiner*—Shih-Chao Chen
(74) *Attorney, Agent, or Firm*—Kenneth P. Robinson

(57) ABSTRACT

Ground based GPS antennas for differential applications may be subject to intentional or other interference signals incident at low elevation angles. Described GPS antenna systems are usable to provide an antenna pattern having a vertically-steerable null. An array of vertically spaced radiator units having omnidirectional azimuth characteristics provides a primary reception pattern. Vertically intermixed radiator units employed on a separate or shared basis provide an auxiliary reception pattern. By subtractively combining the auxiliary pattern with the primary pattern and adjusting the relative signal level of the auxiliary pattern a vertically-steerable pattern null is provided. The antenna system may include an adaptive control system responsive to an antenna output signal to derive a steering signal to adjust the relative signal level of the auxiliary pattern to steer the vertically-steerable null to provide interference suppression. Antenna systems and methods are described.

20 Claims, 10 Drawing Sheets

GPS ANTENNA SYSTEMS AND METHODS WITH VERTICALLY-STEERABLE NULL FOR INTERFERENCE SUPPRESSION

RELATED APPLICATIONS (Not Applicable)

FEDERALLY SPONSORED RESEARCH (Not Applicable)

BACKGROUND OF THE INVENTION

This invention relates to antennas to receive signals from Global Positioning System (GPS) satellites and, more specifically to antenna systems arranged for reception for differential GPS applications.

Antenna systems providing a circular polarization characteristic in all directions horizontally and upward from the horizon, with a sharp cut-off characteristic below the horizon are described in U.S. Pat. No. 5,534,882, issued to A. R. Lopez on Jul. 9, 1996 (which may be referred to as "the '882 patent"). Antennas having such characteristics are particularly suited to reception of signals from GPS satellites.

As described in that patent, application of the GPS for aircraft precision approach and landing guidance is subject to various local and other errors limiting accuracy. Implementation of Differential GPS (DGPS) can provide local corrections to improve accuracy at one or more airports in a localized geographical area. A DGPS ground installation provides corrections for errors, such as ionospheric, tropospheric and satellite clock and ephemeris errors, effective for local use. The ground station may use one or more GPS reception antennas having suitable antenna pattern characteristics. Of particular significance is the desirability of antennas having the characteristic of a unitary phase center of accurately determined position, to permit precision determinations of phase of received signals and avoid introduction of phase discrepancies. Antenna systems having the desired characteristics are described and illustrated in the '882 patent, which is hereby incorporated herein by reference.

For such applications, antennas utilizing a stack of individually-excited progressive-phase-omnidirectional elements are described in U.S. Pat. No. 6,201,510, issued to A. R. Lopez, R. J. Kumpfbeck and E. M. Newman on Mar. 13, 2001 ("the '510 patent"). Elements as described therein include self-contained four-dipole elements which are employed in stacked configuration to provide omnidirectional coverage from the zenith (90 degrees elevation) to the horizon (0 degrees) or from a high elevation angle to the horizon, with a sharp pattern cut off below the horizon. The '510 patent is hereby incorporated herein by reference.

Objects of the present invention are to provide new and improved antennas and methods, including antennas and methods usable for DGPS applications and which may provide one or more of the following characteristics and advantages:

vertically-steerable null;

null steerable for low elevation interference suppression;

adaptively controlled null steering capability;

omnidirectional azimuth coverage with elevation coverage up from the horizon;

wide frequency band operability;

progressive-phase-omnidirectional azimuth pattern; and operable with circularly polarized signals.

SUMMARY OF THE INVENTION

In accordance with the invention, an embodiment of a GPS antenna system includes a vertically extending structure, an array of primary radiator units supported by that structure at vertically spaced positions and an array of auxiliary radiator units supported by the structure each at a position adjacent to at least one of the primary radiator units. Each radiator unit is configured to provide an omnidirectional azimuth pattern. An excitation configuration is coupled to each of the primary radiator units and to each of the auxiliary radiator units and arranged to provide at a first port a first signal formed by combining at predetermined relative signal levels signals received via the primary radiator units and at a second port a second signal formed by combining at predetermined relative signal levels signals received via the auxiliary radiator units. An adjustable signal combiner coupled to the first and second ports and arranged to subtractively combine the first and second signals with relative signal levels at least one of which is adjustable to provide, at an output port, an output signal representative of an antenna pattern having a vertically-steerable null.

The system may also include an adaptive control system responsive to the output signal and arranged to implement adaptive processing techniques to provide a steering signal to the adjustable signal combiner to control adjustment of the signal level of at least one of the first and second signals to steer the vertically-steerable null.

Also in accordance with the invention, a method usable to provide an antenna pattern having a vertically steerable null may include the steps of:

(a) providing a vertical array of radiator units each configured to provide an omnidirectional azimuth pattern;

(b) selecting a first plurality of radiating units and a second plurality of radiator units, one or more of which may be included in both of the first and second pluralities of radiator units;

(c) providing a first signal formed by combining at predetermined relative signal levels signals received via the first plurality of radiator units and a second signal formed by combining at predetermined relative signal levels signals received via the second plurality of radiator units;

(d) combining the first and second signals subtractively with relative signal levels, at least one of which is adjustable, to provide an output signal representative of an antenna pattern having a vertically-steerable null.

This method may further include the step of:

(e) implementing adaptive processing techniques responsive to the output signal to provide a steering signal to adjust the relative signal level of at least one of the first and second signals to steer the vertically-steerable null.

For a better understanding of the invention, together with other and further objects, reference is made to the accompanying drawings and the scope of the invention will be pointed out in the accompanying claims.

DESCRIPTION OF THE INVENTION

Figure 1:
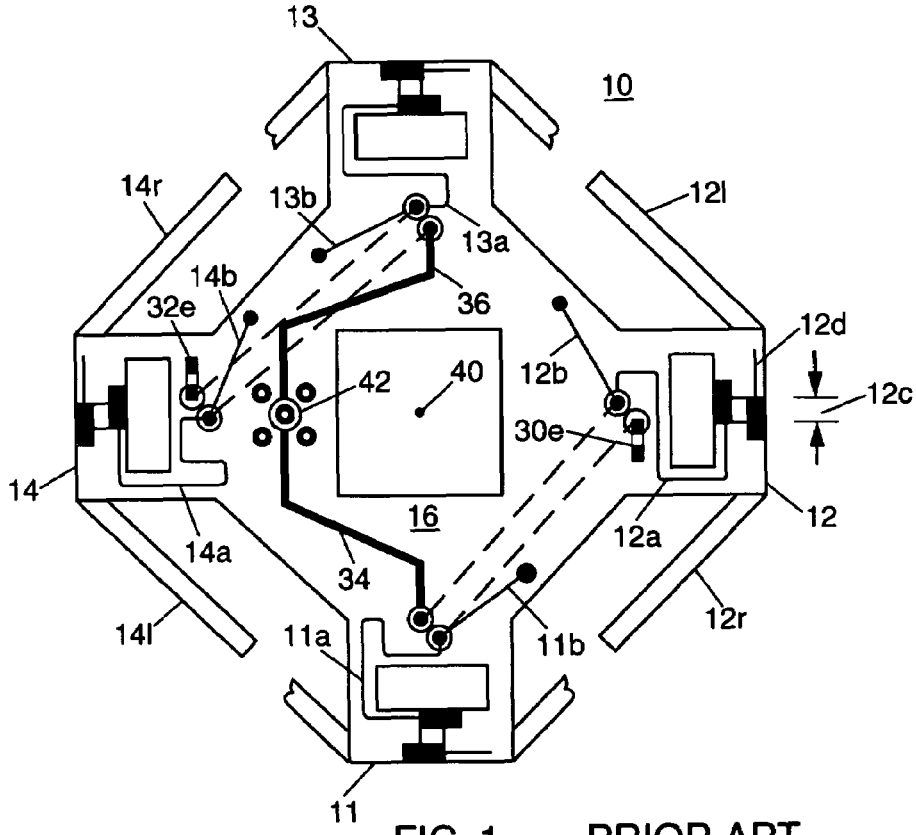
FIG. 1 PRIOR ART
FIG. 1 is a top view of a four-dipole sub-array configuration usable in antennas pursuant to the invention (two dipoles are shown with partial arms for clarity of presentation).
Figure 2:
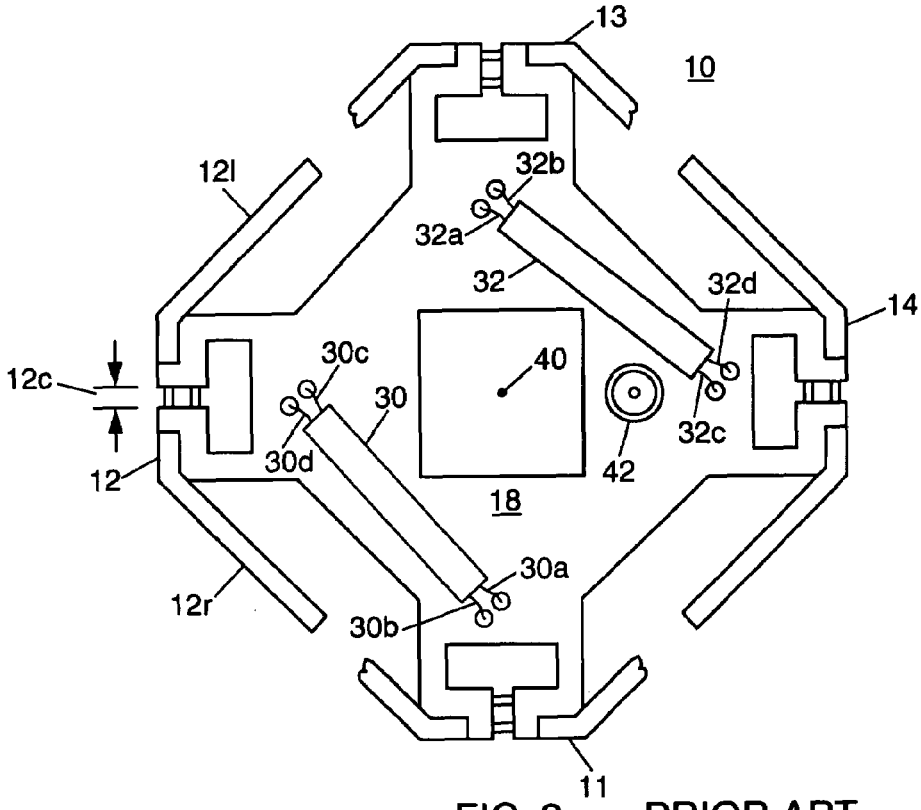
FIG. 2 PRIOR ART
FIG. 2 is a bottom view of the FIG. 1 sub-array.
Figure 3:
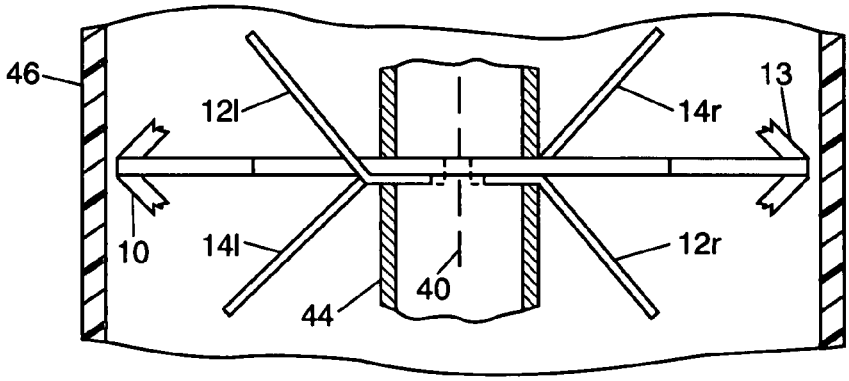
FIG. 3 PRIOR ART
FIG. 3 is a side view of the FIG. 1 sub-array.
Figure 5:
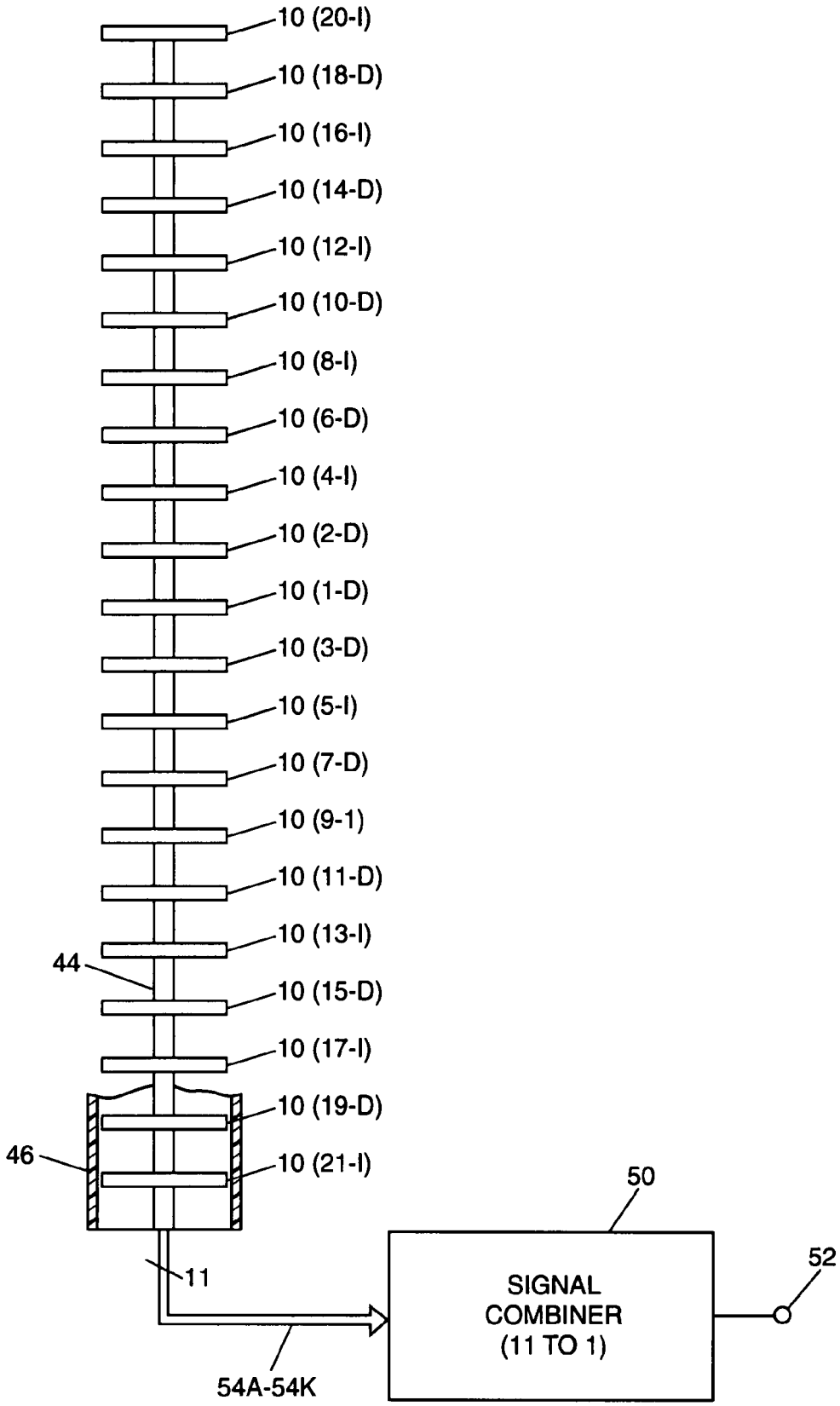
FIG. 5 PRIOR ART
FIG. 5 illustrates a GPS antenna system including an array of 21 radiator units, each of which may be of the type shown in FIGS. 1, 2 and 3 and eleven of which are directly excited, with the remaining ten indirectly excited.

FIGS. 1, 2 and 3 are respective top, bottom and side views of a form of four-dipole sub-array usable in a GPS antenna system such as shown in FIG. 5. The FIG. 5 antenna system is configured to provide horizon (i.e., zero degrees) to Zenith (i.e., 90 degrees) elevation coverage, with omnidirectional azimuth coverage, for reception of circularly polarized signals.

FIG. 1 shows a four-dipole sub-array 10 including first, second, third and fourth dipoles 11, 12, 13, 14, respectively. Each dipole includes two opposed arms. The ends of the arms of dipoles 11 and 13, which would overlap arms of adjacent dipoles in this view, have been partially removed for clarity of illustration. In actual use, all four dipoles would typically be of substantially identical construction. This four-dipole configuration is shown and described in the '510 patent.

FIG. 1 illustrates an implementation using printed circuit techniques. In FIG. 1, conductor configurations are supported on the top surface of an insulative layer or substrate 16. The bottom view of FIG. 2, shows the bottom surface of a conductive (e.g., copper) layer 18 adhered to substrate 16. In this embodiment, individual arms of the dipoles (e.g., arms 12*l* and 12*r* of second dipole 12) are separately fabricated and soldered or otherwise attached at appropriate positions to the conductive layer 18. At particular locations, circuit connections pass through openings in conductive layer 18 and substrate 16 to circuit portions above. At other locations circuit connections pass through substrate 16 from above to make conductive contact with layer 18, which represents ground potential. Sub-array 10 includes a square central cutout suitable to receive a square conductive member and other cutouts to be described.

As shown in the FIG. 3 side view of the FIG. 1 four-dipole sub-array, opposed arms 12*l* and 12*r* of dipole 12 extend respectively upward and downward at approximately 45 degrees diagonally to horizontal. Arms 14*l* and 14*r* of dipole 14, at the back of configuration 10 in the view of FIG. 3, are also visible. The four dipoles 11, 12, 13, 14 are successively spaced around a vertical axis 40, shown dashed in FIG. 3 and in end view in FIGS. 1 and 2. Dipole arms are labeled l and r, representing the left arm and right arm of a particular dipole when viewed from vertical axis 40 (i.e., viewed from a position above the top surface of element 10, looking outward from axis 40).

Four-dipole sub-array 10 includes a port illustrated as coaxial connector 42. Connector 42 is shown in FIGS. 2 and 3 with its outer conductor portion mounted to conductive layer 18 and its center conductor passing through layer 18 to the upper surface of substrate 16.

Sub-array 10 also includes a progressive-phase-omnidirectional (PPO) excitation network coupled between port 42 and dipoles 11, 12, 13, 14. As illustrated, the PPO network includes first and second quadrature couplers 30 and 32, respectively, as shown in FIG. 2 and first and second transmission line sections 34 and 36, respectively, as shown in FIG. 1. Couplers 30 and 32 in this embodiment are wireline quadrature couplers having an external encasement which is soldered or otherwise grounded to conductive layer 18. Each wireline device is a 3 dB coupler having four signal port conductors: input port "a"; output port "b" providing signals of the same phase as input signals; output port "c" providing signals of quadrature phase (i.e., 90 degree phase lag relative to input signals); and port "d" which is resistively terminated (e.g., 50 ohms to ground). While signal input terminology is used for convenience, it will be understood that the couplers operate reciprocally for the present signal reception application.

Considering both the bottom view of FIG. 2 and the top view of FIG. 1, it will be seen that port a conductor 30*a* of wireline coupler 30 is coupled through layers 18/16 and coupled to signal port 42 via line section 34. Port b conductor 30*b* is coupled through layers 18/16 and coupled to the left arm of first dipole 11, via conductor 11*a*, to provide first dipole excitation of a first phase. Conductor 11*a* and associated shorted stub 11*b* (connected to layer 18 through layer 16) are appropriately dimensioned to provide suitable impedance matching to the dipole using known design techniques. Similarly, port c conductor 30*c* is coupled to the left arm of second dipole 12 via conductor 12*a* to provide second dipole excitation of a quadrature phase (i.e., differing by 90 degrees). Port d conductor 30*d* passes through layers 18/16 and is terminated by a 50 ohm chip resistor 30*e* mounted on the surface of layer 16 and grounded to layer 18.

Second wireline quadrature coupler 32 is correspondingly coupled to third and fourth dipoles 13 and 14, however, in this case couplings are to the right arms of dipoles 13 and 14 (rather than to the left arms, as above). Thus, port a conductor 32*a* of coupler 32 is coupled to signal port 42 via second transmission line section 36. Port b conductor 32*b* (zero phase) is coupled to the right arm of third dipole 13, via conductor 13*a*, with the phase reversal from opposite-arm excitation (i.e., via right arm v. left arm above) resulting in third dipole excitation of a phase opposite (i.e., differing by 180 degrees) to the first phase excitation of first dipole 11 (e.g., 180 degrees lag). Port c conductor 32*c* (quadrature phase) is coupled to the right arm of fourth dipole 14, via conductor 14*a*, with the quadrature phase and phase reversal from opposite arm excitation resulting in fourth dipole excitation of a phase opposite to the second phase excitation of second dipole 12 (e.g., 180 degrees lag). Port d conductor 32*d* is resistively terminated via chip resistor 32*e*. Shorted stubs 12*b*, 13*b*, and 14*b* as shown are provided for dipoles 12, 13 and 14 as discussed above with reference to stub 11*b*.

During signal reception, this sub-array configuration is effective to provide at signal port 42 a signal representative of reception via a 360 degree PPO azimuth antenna pattern. Thus, the PPO network is effective to provide relative signal phasing of zero, −90, −180 and −270 degrees at first, second, third and fourth dipoles 11, 12, 13, 14, respectively, with received signals combined to provide the PPO signal at port 42. The four-dipole configuration 10 thus operates as a self-contained unit to provide this PPO capability.

For effective GPS operation, the four-dipole sub-array as configured in FIGS. 1-3 is double tuned for operation at two GPS frequencies of 1,572.42 MHZ and 1,227.6 MHZ. With reference to second dipole 12, double tuning is provided by a tuned circuit utilizing the inductance of a stub comprising gap 12*c* backed up by a rectangular opening in conductive layer 18, in combination with capacitive stub 12*d* connected to layer 18 and overlying a portion of dipole 12. Provision of this tuned circuit enables the dipole to be double tuned using known design techniques, to enable reception at both GPS signal frequencies.

By way of example, the four-dipole sub-array 10 may be fabricated as a self-contained unit using printed circuit techniques, with the dipole arms, wireline quadrature couplers and coaxial connector soldered in place. For GPS application, the sub-array 10 may have typical dimensions of approximately three and a quarter inches across and an inch and a quarter in height. The sub-array is shown slightly enlarged and some dimensions may be distorted for clarity of presentation. The square central opening is dimensioned for placement on a square conductive member 44 of hollow construction (e.g., a square aluminum vertical support or mast shown sectioned in FIG. 3) with electrical connection of ground layer 18 to the member 44.

Figure 4A:
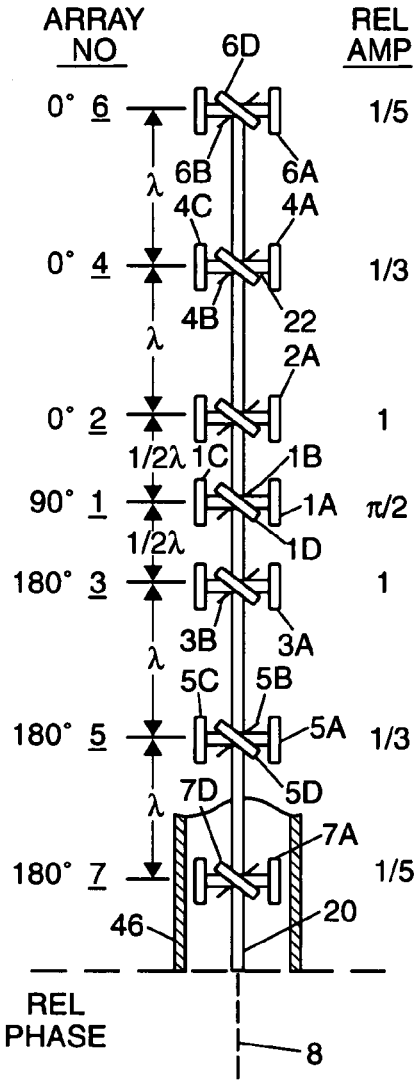
FIG. 4a PRIOR ART
FIG. 4*a* and FIG. 4*b* illustrate an antenna system including an array of seven sub-arrays, each of which may be of the type shown in FIGS. 1, 2 and 3.

Reference is made to FIG. 4*a* which illustrates a form of antenna system described in U.S. Pat. No. 5,534,882 (the '882 patent). The FIG. 4*a* antenna system is arranged to provide a first circular polarization characteristic (e.g., right circular polarization) horizontally and upward from the horizon.

Figure 4B:
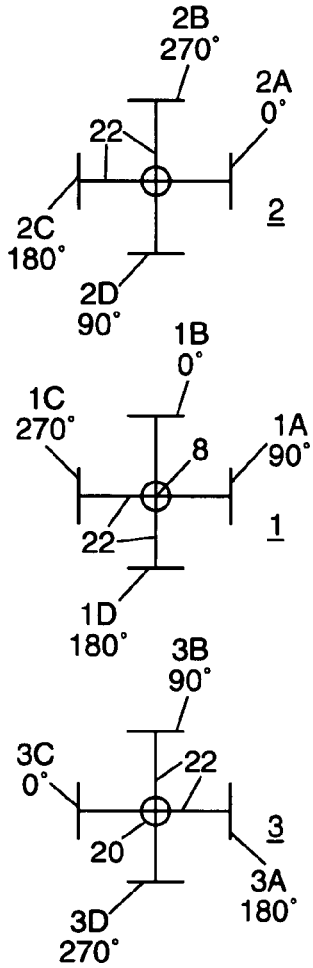
FIG. 4b PRIOR ART

Referring to the FIG. 4*a* antenna system, a mast 20 supporting the antenna system is shown centered on the vertical axis 8 and normal to the horizontal plane. As illustrated, the antenna system includes a plurality of sub-arrays, shown as sub-arrays 1-7, spaced along mast 20. Considering sub-array 1, it consists of four dipoles each supported by coupling means illustrated as a base portion (such as shown at 22 with respect to dipole 1A) extending from mast 20. As shown for dipole 1D, each dipole is tilted so that its arm portions are at an angle of approximately 45 degrees. In FIG. 4*a* dipole 1D is in the front (permitting its tilted orientation to be seen), side dipoles 1A and 1C are seen in side profile and rear dipole 1B is shown in simplified form as a tilted line (to distinguish it from front dipole 1D). The A, B, C, D dipole labeling is typical for each of the other dipole arrays 2-7. The FIG. 4*a* antenna system looks the same when viewed from the front, the back or either side. Thus, except for the specific dipole labels as shown, FIG. 4*a* may be considered a front, back or side view. FIG. 4*b* shows simplified top views of sub-arrays 1, 2, and 3 of the FIG. 4*a* antenna, illustrating the symmetrical character of the four dipoles of each sub-array. As shown, the four dipoles of each sub-array are equally spaced around the mast 20 at 90 degree angular increments. The boresight of each dipole is thus aligned at an azimuth angle differing from the boresight angle of each other dipole in its sub-array by an integral multiple of 90 degrees.

In overview, it will thus be seen that each sub-array provides a PPO antenna pattern, however, the signal phasing at sub-arrays 2 and 3 have respectively been rotated forward (lead) and backward (lag) by 90 degrees relative to the signal phasing of sub-array 1.

As a result of excitation as described, with four 45 degree angled dipoles positioned symmetrically around mast 20 and supplied with signals as described, sub-array 1 will be effective to produce a right circular polarized radiation pattern around axis 12 which has a 360 degree PPO characteristics, as indicated by the relative phasing shown for dipoles 1A, 1B, 1C and 1D in FIG. 4*b*. Similarly, signals are coupled to the dipoles of the second sub-array of relative phase effective to produce a second PPO radiation pattern around axis 12 similar to the first such pattern, but which is shifted in azimuth by an angle of 90 degrees (i.e., 90 degrees phase lag) and to dipoles 3A, 3B, 3C and 3D to produce a similar 360 degree third PPO radiation pattern also shifted in azimuth relative to the first such pattern (i.e., 90 degrees phase lead). Additional sub-arrays (e.g., some or all of sub-arrays 4, 5, 6 and 7, plus additional similar arrays as suitable in particular applications) may be included and excited to provide appropriately aligned 360 degree circularly polarized PPO radiation patterns. Additional details as to the feed configuration, construction and operation of the FIG. 4*a* antenna system are provided in the '882 patent.

FIG. 5 illustrates a form of GPS antenna which utilizes a vertical array of radiator units in the form of four-dipole sub-arrays, including a four-dipole first sub-array 10 (1-D) and a plurality of additional identical sub-arrays, including ten upper sub-arrays positioned above first sub-array 10 (1-D) and ten lower sub-arrays positioned below first sub-array 10 (1-D). The sub-arrays are supported along rectangular mast 44 with vertical element-to-element spacings of approximately one-half wavelength at a frequency in the operating range. In this example, each of the sub-arrays may be is identical to sub-array 10 of FIGS. 1-3. Each sub-array is identified with the reference numeral 10, indicating correspondence to sub-array 10 of FIGS. 1-3, and a parenthetical indicating the individual sub-array number and whether it is directly excited by connection to signal combiner 50 (e.g., sub-array 10 (4-D) is directly excited) or indirectly excited and not connected to signal combiner 50 (e.g., sub-array element 10 (6-I) is indirectly excited). As shown, the directly excited ten upper sub-arrays 10 (2-D), 10 (4-I), 10 (6-D), 10 (8-I), 10 (10-D), 10 (12-I), 10 (14-D), 10 (16-I), 10 (18-D) and 10 (20-I) positioned above first sub-array 10 (1-D) all have individual sub-array numbers which are even and indirectly excited sub-arrays are in alternating positions each adjacent to at least one directly excited sub-array. Also, the ten lower sub-arrays 10 (3-D), 10 (5-I), 10 (7-D), 10 (9-I), 10 (11-D), 10 (13-I), 10 (15-D), 10 (17-I), 10 (19-D), and 10 (21-I) positioned below first sub-array 10 (1-D) all have individual sub-array numbers which are odd and indirectly excited sub-arrays are in alternating positions with directly excited sub-arrays.

Although sub-arrays are described in terms of being directly or indirectly "excited", it will be understood the FIG. 5 antenna is intended for reception of GPS satellite signals. As represented in FIG. 5, received signals are provided to signal combiner 50 by eleven signal paths 54A-54K (e.g., coaxial cables). Each of cables 54A-54K, which are typically of equal length, connects to the signal port (e.g., connector 42 of the FIG. 1 sub-array) of one of the eleven directly excited sub-arrays. In this embodiment there are no cable connections to the ten indirectly excited sub-arrays, the signal ports of which may be suitable terminated. To provide the desired antenna pattern as discussed above with reference to the FIG. 4*a* antenna system, signal combiner 50 is arranged to: provide reference phase signals to the first sub-array (sub-array 10 (1-D) the center sub-array); provide to each of the directly excited upper sub-arrays signals which lag that reference phase by 90 degrees; and provide to each of the directly excited lower sub-arrays signals which lead by 90 degrees. As an alternative, it will be apparent that the desired PPO excitations which lead and lag by 90 degree phase differentials can be provided by permanently rotating selected sub-arrays by 90 degrees in azimuth and coupling of reference or some phase signals to each of the eleven directly excited sub-arrays.

Thus, for this alternative configuration all of the upper sub-arrays above first sub-array 10 (1-D) can be placed on the square mast 44 in a physical alignment rotated forward (clockwise, looking down from above) one quarter turn or 90 degrees, relative to the first sub-array. Similarly, all of the lower sub-arrays can be placed on the square mast 44 in a physical alignment rotated backward one quarter turn or 90 degrees, relative to the first sub-array 10 (1-D). The FIG. 5 antenna and its operation are more fully described in the '510 patent.

Figure 6:
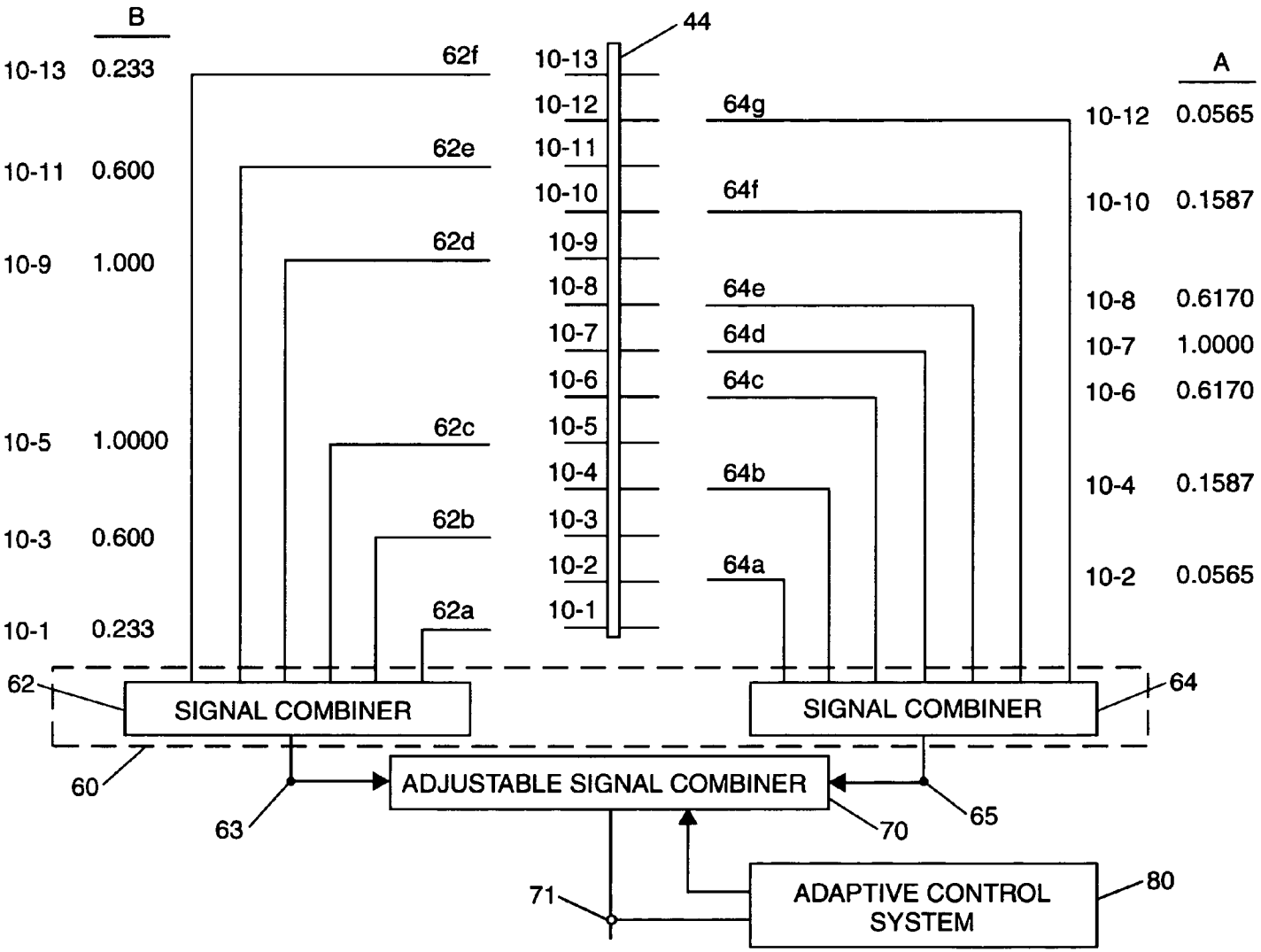
FIG. 6 illustrates an embodiment of a GPS antenna system utilizing the invention.

Referring now to FIG. 6 there is illustrated an embodiment of a GPS antenna system usable to provide a vertically-steerable null in accordance with the invention. The antenna system includes a vertically extending structure 44, which may be an antenna mast of any suitable type.

Also included is an array of primary radiator units 10-2, 10-4, 10-6, 10-7, 10-8, 10-10 and 10-12 supported by structure 44 at vertically spaced positions and each configured to provide an omnidirectional azimuth pattern. In one currently preferred embodiment each of these radiator units may comprise a four-dipole sub-array. Each such sub-array may be of the type described with reference to FIGS. 1-3, having a single input/output connection and arranged to provide an omnidirectional azimuth pattern. In other implementations each primary radiator unit may be provided by skilled persons in any suitable configuration effective to provide an omnidirectional azimuth pattern, which will typically provide approximately equal coverage at all azimuths.

As further shown in FIG. 6, the antenna system includes an array of auxiliary radiator units 10-1, 10-3, 10-5, 10-9, 10-11 and 10-13 supported by structure 44 each at a position adjacent to at least one of the primary radiator units and each configured to provide an omnidirectional azimuth pattern. In a currently preferred embodiment, the auxiliary radiator units are of construction identical to the primary radiator units as described above. It can be noted that while the present antennas may be employed for receiving GPS signals, it has been found more convenient for purposes of description to use transmission terminology (e.g., "radiator"), however the devices involved typically have reciprocal transmission/reception properties.

The antenna system includes an excitation configuration 60, which may comprise one or more units, coupled to each of the primary and auxiliary radiator units. As illustrated, excitation configuration 60 comprises first and second signal combiners 64 and 62. In this example, first signal combiner 64 is represented as being coupled to primary radiator units 10-2, 10-4, 10-6, 10-7, 10-8, 10-10, 10-12 by respective signal paths 64*a*, 64*b*, 64*c*, 64*d*, 64*e*, 64*f*, 64*g*, which may be coaxial or other suitable signal transmission media and may provide transmission paths of equal effective electrical length for wide-band operation. In physical implementation, paths 64*a*-64*g* may be provided by conductive paths or cables proceeding from combiner 64 to the base of structure 44 and continuing within structure 44 to each respective radiator unit (e.g., unit 10-7). In FIG. 6 for purposes of improved visual presentation the signal paths 64*a*-64*g* are graphically represented external to the structure 44.

Excitation configuration 60 is arranged to provide at a first port 65 a first signal formed by combining at predetermined relative signal levels (e.g., voltage levels) signals received via the primary radiator units. Thus, in this example signals coupled from the primary radiator units to first signal combiner 64, by means of the respective transmission paths 64*a*-64*g*, are additively combined at the relative signal levels shown in column A in FIG. 6 (i.e., signal from radiator unit 10-7, 1.0000 relative units, signal from radiator unit 10-8, 0.6170 relative units, etc.) with the combined signal provided at first port 65. As shown, second signal combiner 62 is represented as being coupled to auxiliary radiator units 10-1, 10-3, 10-5, 10-9, 10-11, 10-13 by respective signal paths 62*a*, 62*b*, 62*c*, 62*d*, 62*e*, 62*f*, which may be coaxial or of other construction as discussed for paths 64*a*, etc. In this manner, excitation configuration 60 is arranged to provide at a second port 63 a second signal formed by combining at predetermined relative signal levels signals received via the auxiliary radiator units. Thus, in this example signals coupled from the auxiliary radiator units to second signal combiner 62, by means of the respective transmission paths 62*a*-62*f*, are additively combined at the relative signal levels shown in column B in FIG. 6 (i.e., signal from radiator unit 10-9, 1.0000 relative units, signal from radiator unit 10-11, 0.600 relative units, etc.) with the combined signal provided at second port 63.

As shown in FIG. 6, an adjustable signal combiner 70 is coupled to the first and second ports 65 and 63 of the excitation configuration 60 (and thereby to first signal combiner 64 and to second signal combiner 62). Adjustable signal combiner 70 is arranged to combine the first and second signals to provide an output signal, at output port 71, which is representative of an antenna pattern having a vertically-steerable null. To achieve this result, the first and second signals are subtractively combined with relative signal levels at least one of which is adjustable (i.e., prior to combination the signal level of the first signal, the second signal, or both, may be adjusted. For present purposes, the term "subtractively combined" means to combine two signals with relative phases which differ (e.g., add together two signals having a 180 degree phase differential).

A GPS antenna system utilizing the invention may also include an adaptive control system 80 coupled to the output port 71 of the adjustable signal combiner, as shown in FIG. 6. In this configuration, adaptive control system 80 is responsive to the output signal at port 71 and arranged to implement adaptive processing techniques to provide a steering signal which will be operatively representative of the incident elevation angle of an interference signal or an approximation of such angle. As shown, adaptive control system 80 is coupled to adjustable signal combiner 70 to enable the steering signal to be coupled to combiner 70 to control vertical steering of the vertically-steerable null. Thus, for example, the steering signal may be employed by adjustable signal combiner 70 to adjust the signal level of the second signal (from the auxiliary radiator units).

As will be further described with reference to FIG. 8, if in the adjustable signal combiner 70 the second signal is added in an out of phase relationship to the first signal (e.g., first signal 0 degrees; second signal 180 degrees phase) the resulting antenna pattern at output port 71 may comprise a low angle portion (e.g., 0-5 degrees elevation) representative of the second signal (to the extent that its signal level exceeds that of the first signal) and a higher angle portion (e.g., above 5 degrees elevation) representative of the first signal (to the extent that its signal level exceeds that of the second signal) and a region (e.g., centered at 5 degrees) in which the out of phase first and second signals effectively cancel each other out, resulting in a null in the antenna pattern which is centered at 5 degrees elevation and is omnidirectional in azimuth. Further, if the signal level of the out of phase second signal is decreased (for steering purposes) prior to its combination with the first signal, the resulting elevational null in the antenna pattern represented by output signal at output port 71 will occur at a lower elevation angle (e.g., the two signals may now add to zero at 4 degrees). Conversely; with an increase in the signal level of the second signal the subtractively combined signals will represent an antenna pattern having a null at a higher elevation angle. Thus, responsive to the steering signal the steerable null can be steered to approximate the incident angle of an incoming interference signal.

A steering signal suitable for use to steer the steerable null can be provided by application of adaptive processing techniques implemented within the adaptive control system 80. For example, since an interference signal may be assumed to be received with an amplitude much greater than that of the satellite transmitted GPS signal, appropriate adaptive processing techniques may be directed to steering the steerable null to the elevation angle which results in a composite (desired GPS signal plus interference signal) output signal of minimum amplitude at output port 71. Thus, if the interference signal represents the largest portion of the composite output signal, steering the null to minimize the composite signal may be expected to result in the maximum obtainable suppression of the interference signal and thereby the best possible reception of the desired GPS signal in the presence of the interference signal. In this context, skilled persons will be enabled to apply known techniques to implement suitable adaptive processing techniques as appropriate to particular implementations and applications of antenna systems provided in accordance with the invention. In some applications it may be desirable to provide for manual null steering. Thus, by observing a visual presentation of the amplitude of the output signal at port 71, an operator may adjust a control knob arranged to control the signal level of the second signal within combiner 70 to a level effective to achieve the maximum obtainable diminution of the observed output signal magnitude and thereby adjust the null to the best elevation angle for GPS signal reception in the presence of the particular interference then being experienced. With employment of automated adaptive processing or manual adjustment as described, the vertically-steerable null may in a presently preferred implementation be steered so as to adjust the null centerline to an elevation angle in the range of about negative eight to plus five degrees elevation. In other implementations it may be desirable (for example, by altering the relative column B values in FIG. 6) to modify the auxiliary antenna pattern in order to provide a steerable null capability at higher elevation angles or to meet other objectives.

Figure 7:
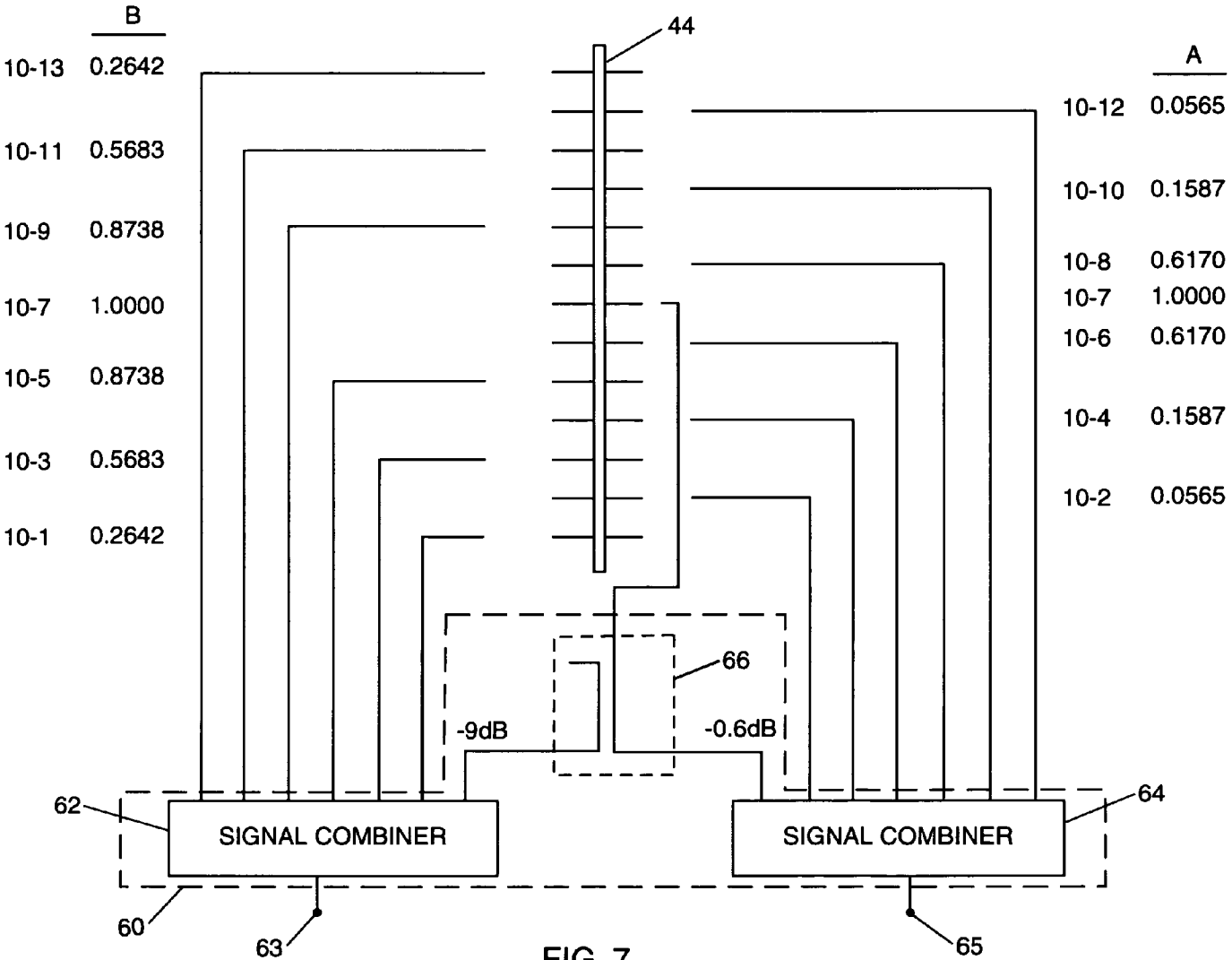
FIG. 7 illustrates a second embodiment of a GPS antenna system utilizing the invention.

FIG. 7 illustrates a GPS antenna system configuration similar to the FIG. 6 antenna system and which may also include an adjustable signal combiner and adaptive control system as described with reference to FIG. 6. The FIG. 7 system is different in that signals received via the center radiator unit 10-7 are utilized in the formation of both of the first and second signals provided at respective first and second ports of the excitation configuration 60. As shown in FIG. 7, a 9 dB directional coupler 66 enables portions of a signal received via radiator unit 10-7 to be coupled to each of signal combiners 64 and 62. In this manner, signal combiner 64 is coupled to radiator units 10-2, 10-4, 10-6, 10-7, 10-8, 10-10, 10-12 and signal combiner 62 is coupled to radiator units 10-1, 10-3, 10-5, 10-7, 10-9, 10-11, 10-13. In this example, first signal combiner 64 is arranged to provide at first port 65 a first signal by combining signals from those first listed radiator units at the listed predetermined relative signal levels (e.g., voltage levels) shown in column A which are the same levels as discussed with reference to the FIG. 6 antenna system. The second signal combiner 62 in the FIG. 7 antenna system is arranged to provide at second port 63 a second signal by combining signals from those latter listed radiator units at the predetermined relative signal levels shown in column B in FIG. 7 (i.e., signal from radiator unit 10-5, 0.8738 relative units, signal from radiator unit 10-7, 1.0000 relative units, etc.). In the shared use context of FIG. 7, radiator unit 10-7 may be referred to as a "primary/auxiliary radiator unit" and may be of the same construction as the other radiator units of the antenna system. With this arrangement, excitation configuration 60 is coupled to the primary/auxiliary radiator unit 10-7 in addition to the other radiator units (designated as primary or auxiliary as for FIG. 6) and arranged to provide at the first and second ports 65 and 63 respective first and second signals each with inclusion at respective predetermined relative signal levels of a signal received via the primary/auxiliary radiator.

Figure 8:
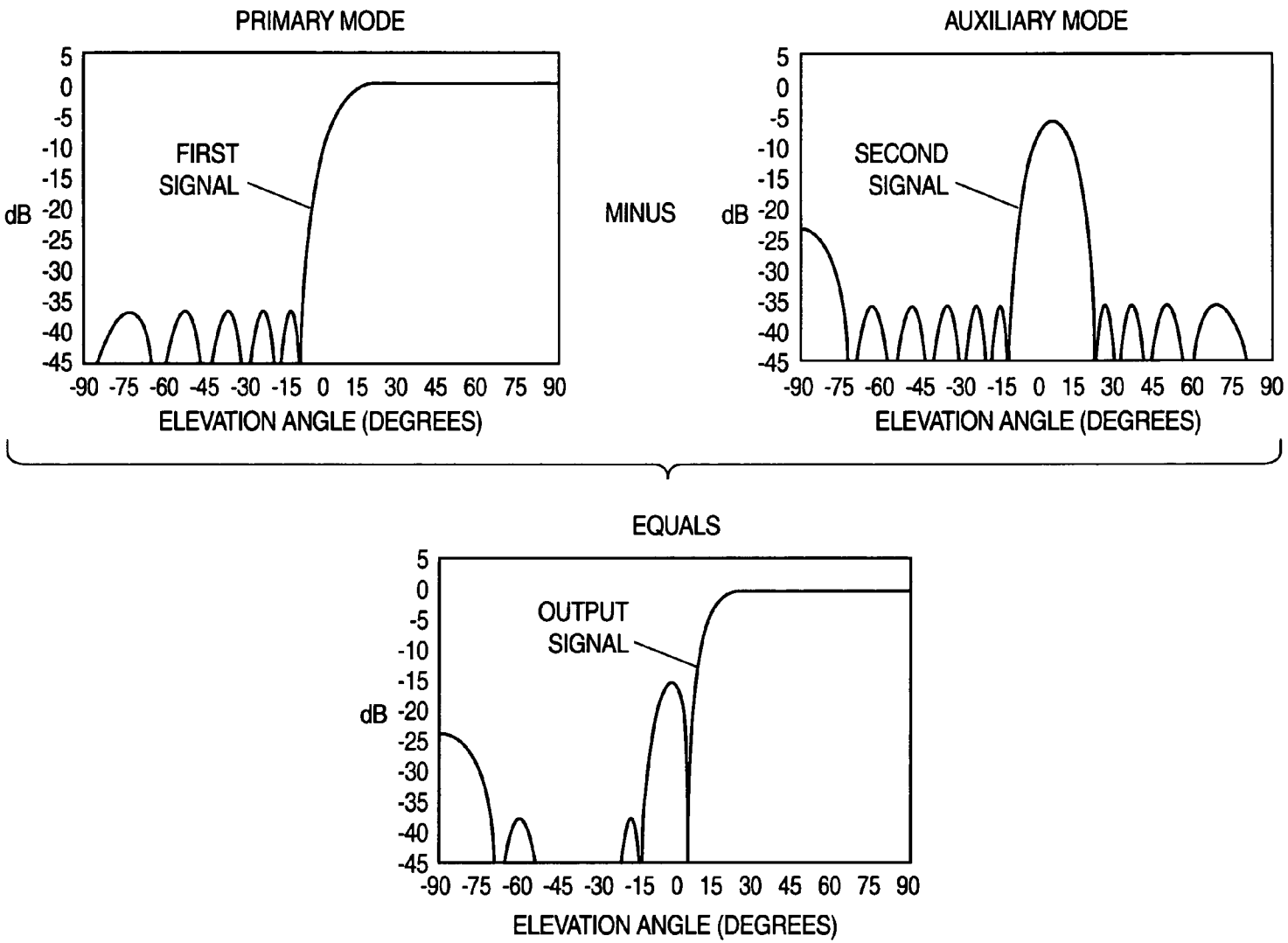
FIG. 8 shows computer-generated antenna patterns useful in describing operation of the FIG. 7 antenna system.

FIG. 8 illustrates basics of formation of the vertically-steerable null for the FIG. 7 antenna system in particular and for the other described antenna systems in general, although the sidelobe characteristics may vary depending basically upon beam shaping and the number of radiator units coupled to the respective first and second signal combiners in each of such other systems. The dependency of sidelobe characteristics upon the number of radiators utilized in an array as well as other antenna characteristics is understood by skilled persons.

In FIG. 8, at upper left is shown the computer-generated elevation antenna pattern represented by the first signal as provided at first port 65 of FIG. 7. As shown, the pattern is basically uniform from about 10 degrees elevation to the zenith or 90 degrees, with a sharp drop-off below the horizon (i.e., zero degrees elevation). At upper right is shown the elevation antenna pattern represented by the second signal as provided at the second port 63 of FIG. 7. As shown, this pattern represents a beam which is relatively narrow in elevation coverage and centered at about five degrees elevation (in azimuth this beam is omnidirectional, as is the pattern shown at upper left). In FIG. 8, the bottom pattern represents the elevation pattern provided by subtractively combining the first and second signals from first and second ports 65 and 63 (e.g., signal from port 63 at 180 degrees phase and signal from port 65 at 0 degrees phase). As shown, a sharp null is provided centered at five degrees elevation. This null is a feature of the antenna pattern represented by the output signal provided at output port 71, in which the signal output for the antenna pattern at elevation angles below five degrees in this example represents the magnitude by which the second signal from port 63 exceeds the level of the first signal from port 65. For the antenna pattern above five degrees elevation the output signal at output port 71 represents the magnitude by which the first signal from port 65 exceeds the level of the second signal from port 63. It will be appreciated that at five degrees elevation in this example the signal levels of the two signals are identical and add to a zero signal level, forming the null.

A further pattern property inherently illustrated by FIG. 8 is the steerability characteristic of the null. It will be seen that in the vicinity of five degrees elevation the upper left pattern (first signal) is decreasing while the upper right pattern (second signal) is at a maximum level. If the upper right pattern is first adjusted to a particular level and then subtractively combined with the upper left pattern the level of the combined signal will net to zero amplitude at a particular angle (e.g., at five degrees elevation). Since each signal has a relatively steep amplitude change characteristic, if the level of the upper right pattern is then adjusted to a higher or lower amplitude and then again combined with the upper left pattern, the combined signal will now net to zero amplitude at a different elevation angle as compared to the first example above. Thus, the null center line is represented by the point of intersection (of the two signals at equal signal levels and of opposite phase) of the right decreasing edge of the upper right auxiliary signal and the left decreasing contour of the upper left primary signal and any relative change in the signal levels will cause a left or right shift in that intersection point as represented by the null elevation angle in the lower pattern of FIG. 8. In this manner, by adjusting the relative levels at which the upper left and upper right patterns are combined, the null represented in the bottom antenna pattern of FIG. 8 may be steered vertically to a higher or lower elevation angle to coincide with the incident elevation angle of an incoming interference signal. For this purpose, the desired relative amplitudes for subtractively combining can be achieved by adjusting the level of the first signal provided to port 65, the second signal provided to port 63, or both. As discussed above, a steering signal for controlling such adjustment can be provided manually or by an adaptive control system, with application of adaptive processing techniques by persons skilled in design and application of adaptive processing for anti-jamming purposes. In this manner, a capability for suppression of interference signals incident upon the antenna system at low elevation angles can be provided to enable improved operation in the presence of interference signals (intentional jamming or otherwise).

Figure 9:
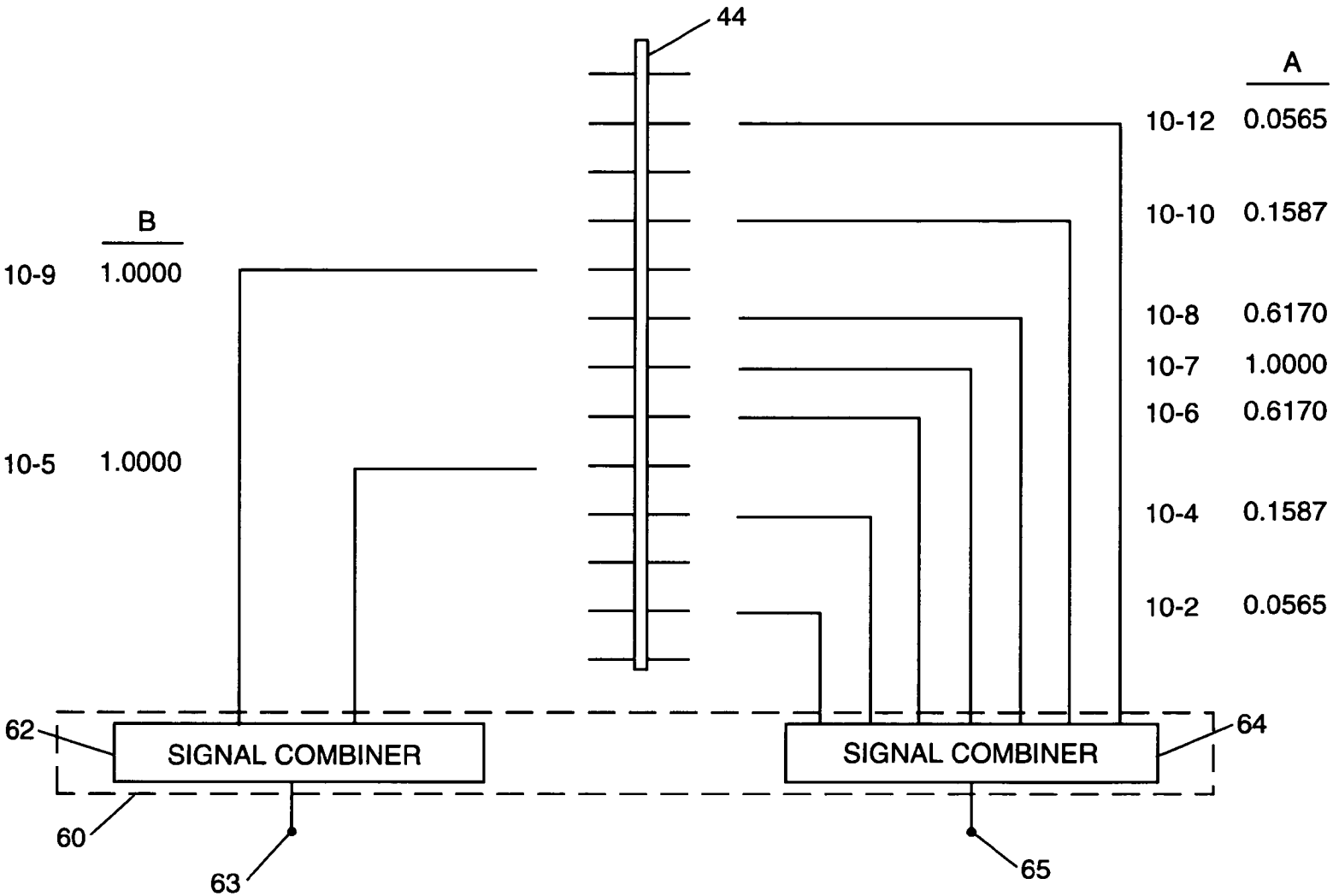
FIG. 9 illustrates a third embodiment of a GPS antenna system utilizing the invention.

FIG. 9 illustrates a further embodiment in which the right side of the antenna system as depicted corresponds to the FIG. 6 system and on the left side second signal combiner 62 is coupled to only two auxiliary radiator units, 10-5 and 10-9. As shown in column B, predetermined relative signal strengths for each of the two auxiliary radiator units is 1.0000 units in this example. This antenna system may also include an adjustable signal combiner (e.g., combiner 70 of FIG. 6) and an adaptive control system (e.g., system 80 of FIG. 6) arranged as shown in FIG. 6 for operation in the same manner as described 10 above with reference to FIG. 6. A vertically-steerable null usable to suppress interference signals incident at low-angle (near-horizon) elevations may thus be provided with use of the FIG. 9 system. Relative to the FIG. 6 antenna system, sidelobe levels will be somewhat higher in the output signal provided at output port 71 and the steerable null may be adjustable over a smaller range of elevation angles above the horizon. It will be seen that in FIG. 9 certain radiator units are shown without indication that they are coupled to either of signal combiners 62 and 64 (i.e., radiator units 10-1, 10-3, 10-11, 10-13). These radiator units, which may be referred to as indirectly excited radiator units and of the same construction as the other radiator units, are not coupled to the excitation configuration. These radiator units may be considered to be indirectly excited elements which provide operative coupling effects to the active radiator units during signal reception and thereby contribute to the form of the antenna pattern. Such indirectly excited elements are further discussed in the '510 patent.

Figure 10:
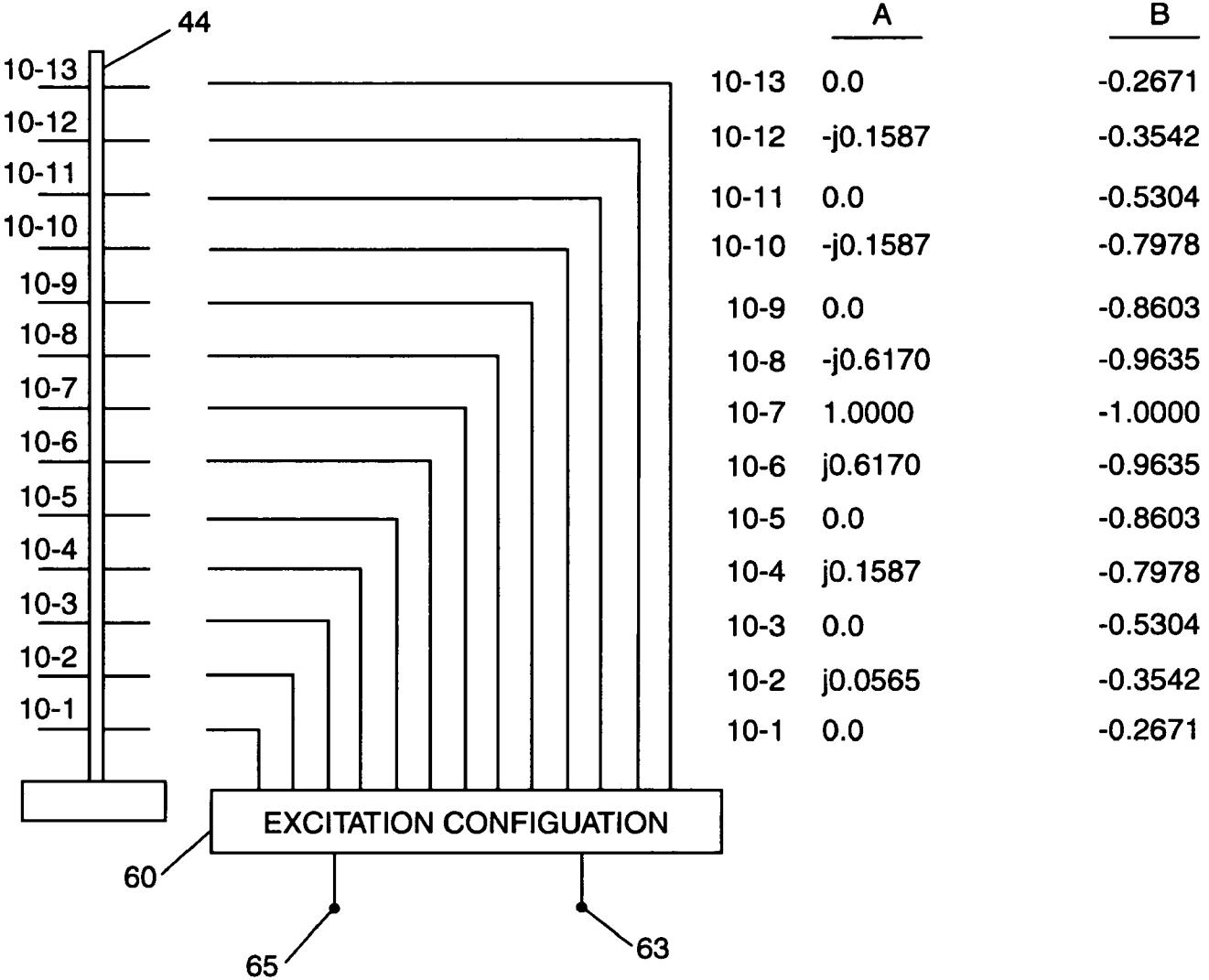
FIG. 10 illustrates a fourth embodiment of a GPS antenna system utilizing the invention.
Figure 11:
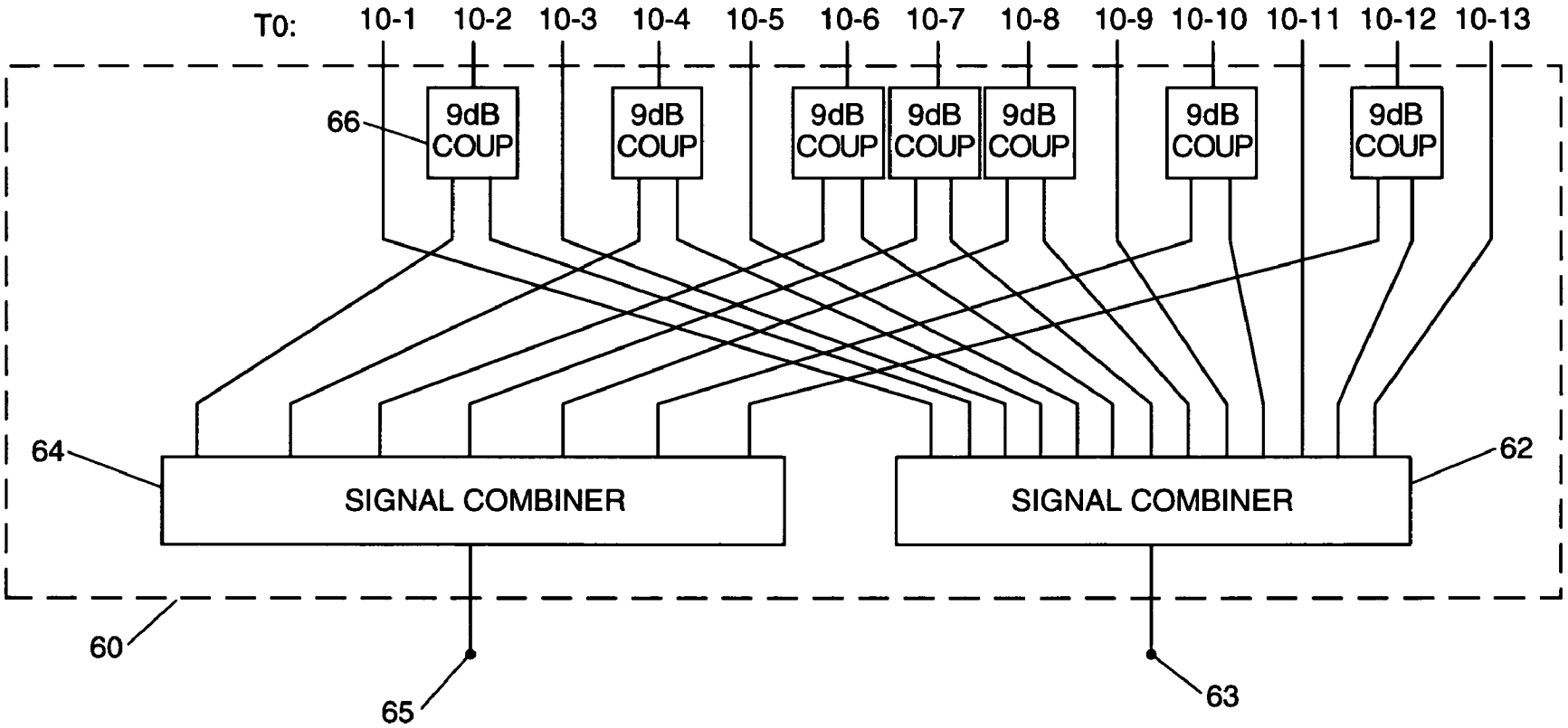
FIG. 11 illustrates details of an implementation of the excitation configuration included in the FIG. 10 antenna system.

FIG. 10 illustrates an embodiment wherein excitation configuration 60 comprises a beam former configuration, an example of which is shown in FIG. 11. All 13 radiator units are coupled to the beam former configuration of FIG. 11. Via the beam former configuration (and directional couplers 66 thereof) signals from seven of the radiator units (10-2, 10-4, 10-6, 10-7, 10-8, 10-10, 10-12) are coupled to the first signal combiner 64 with predetermined relative signal strengths as listed in column A included in FIG. 10. Signals from all of the radiator units are coupled to the second signal combiner 62 with predetermined relative signal strengths as listed in column B included in FIG. 10. An adjustable signal combiner (e.g., combiner 70 of FIG. 6) may be coupled to first and second ports 65 and 63 as shown in FIG. 6 and an adaptive control system (e.g., system 80 of FIG. 6) may be coupled to such adjustable signal combiner as shown in FIG. 6, for operation in the same manner as described above with reference to FIG. 6. As labeled in FIG. 11 directional coupler 66 is representative of the seven correspondingly positioned units shown in the coupling paths of radiator units 10-2, 10-4, 10-6, 10-7, 10-8, 10-10, 10-12, which may each be of the type discussed above with reference to coupler 66 of FIG. 7. In particular implementations skilled persons may provide any suitable form of device to enable dual use of signals from particular radiator units. The FIG. 10 antenna system as described may be employed to provide a vertically-steerable null usable to suppress interference signals incident at near-horizon elevation angles. Relative to the FIG. 6 antenna system, sidelobe levels in the output signal and grating lobe effects introduced at relatively low levels via the auxiliary signals may be further reduced or suppressed by employment of the FIG. 10 configuration to provide an enhanced level of performance which may be appropriate in some applications.

Figure 12:
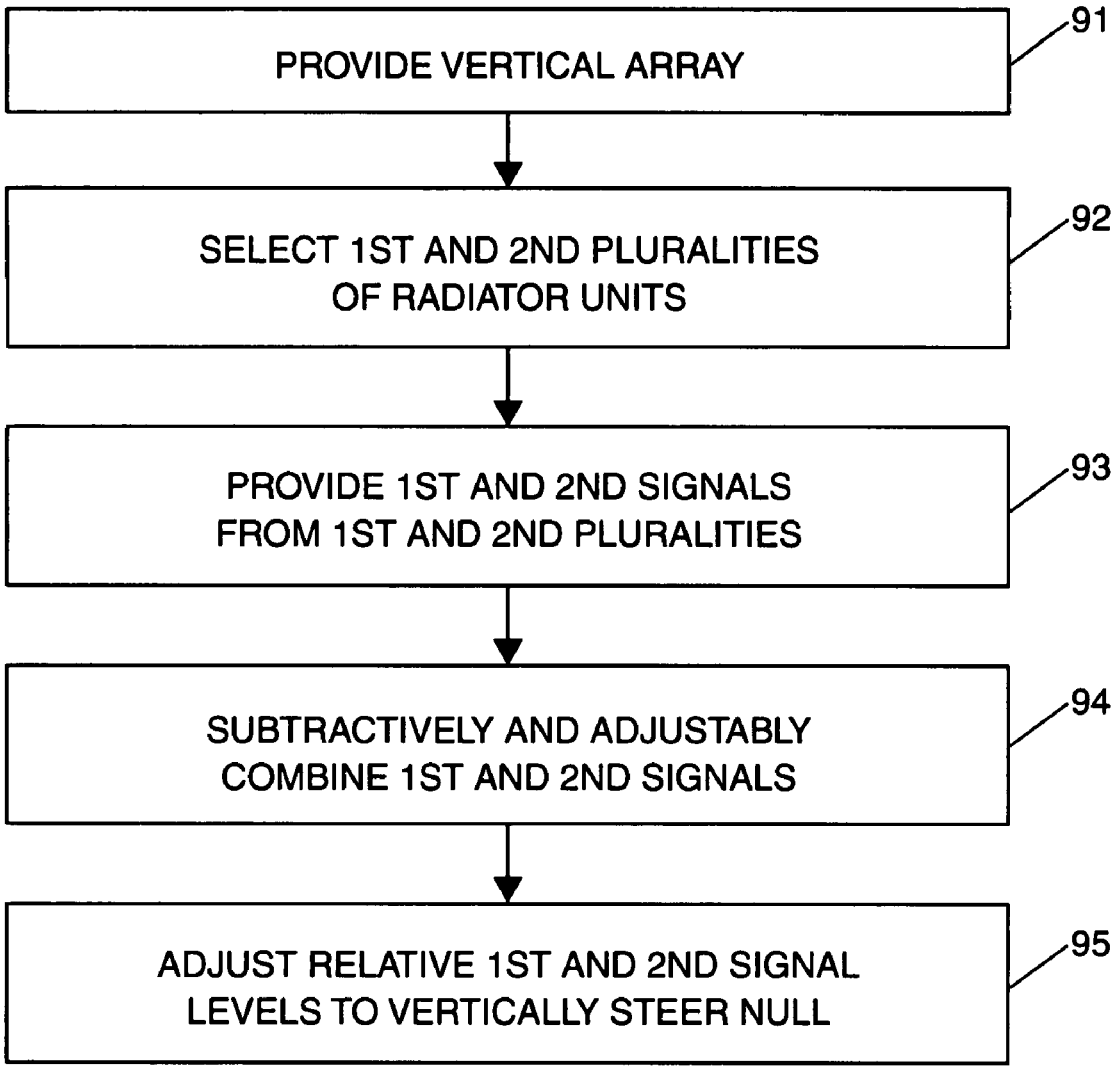
FIG. 12 is a form of flow chart useful in describing a method utilizing the invention.

FIG. 12 is a form of flow chart useful in describing steps of an exemplary method, usable to provide an antenna pattern having a vertically-steerable null. These steps are:

(a) at 91 there is provided a vertical array of radiator units (e.g., units 10-1 to 10-13 of FIG. 6) each configured to provide an omnidirectional azimuth pattern;

(b) at 92 there are selected a first plurality of radiating units (e.g., units 10-2, 10-4, 10-6, 10-7, 10-8, 10-10, 10-12) and a second plurality of radiator units (e.g., units 10-1, 10-3, 10-5, 10-9, 10-11, 10-13 of FIG. 6), one or more of which may also be included in the first plurality of radiator units (e.g., as in FIGS. 7 and 10);

(c) at 93 there are provided a first signal (e.g., at port 65) formed by combining at predetermined relative signal levels signals received via the first plurality of radiator units and a second signal (e.g., at port 63) formed by combining at predetermined relative signal levels signals received via the second plurality of radiator units;

(d) at 94 the first and second signals are combined in a subtractive manner with relative signal levels, at least one of which is adjustable, to provide an output signal (e.g., at port 71) representative of an antenna pattern having a vertically-steerable null; and (e) at 95 implementing adaptive processing techniques (e.g., via unit 80 of FIG. 6) responsive to the output signal to provide a steering signal to adjust the relative signal level of at least one of the first and second signals to steer the vertically-steerable null.

With an understanding of the invention, skilled persons will be enabled to separately or in combination add, delete, modify or change the order of steps as may be appropriate in particular implementations and consistent with available antenna and other techniques. Thus, for example, it may be appropriate to omit step (d) and substitute manual (as discussed above) or other arrangements to control adjustment of the relative signal levels in step (d). Steps of this method may be implemented as described with reference to the antenna system figures described above or implemented in any suitable manner by skilled persons, as appropriate for particular applications and employing any suitable devices, units and techniques. Thus, for example, at 92 the first and second pluralities of radiator units may be selected with all radiator units of the first plurality also included in the second plurality, as in FIG. 10.

As described above, antenna system implementations enable automatic steering of an elevation null in elevation (e.g., from negative 8 degrees to positive 5 degrees) with introduction of performance degradation which may be operatively acceptable or very minor in most applications. Established adaptive processing techniques may be adapted for application to provide a steering signal to steer a vertically-steerable null to the elevation angle approximating that of interference signals incident at low elevation angles. As described, near-horizon elevation null steering can provide effective suppression of near-horizon interference, without unacceptable reduction in performance in the GPS satellite coverage sector. By alteration of the antenna pattern provided by the excitation of the auxiliary radiator units, the null position, shape, etc., may be altered to provide nulling at higher elevation angles or otherwise as may be appropriate in particular implementations.

Based on computer simulation it has been determined that elevation null steering as described does not result in significant degradation of the quality of the antenna phase center. The antenna array factor phase center has been determined to be located at or very close to the center of the middle radiator unit. Operatively, mutual coupling between radiator units may result in some non-dispersive delay causing slight migration downward of the antenna phase center (e.g., on the order of 4 cm. downward).

While implementation may be provided in any suitable manner by skilled persons informed of the invention, it is considered desirable to provide signal transmission paths (e.g., coaxial cables) of equal electrical length and otherwise maintain frequency independent phase characteristics in order to provide desired null quality across the L1, L2 and L5 frequencies associated with GPS operations. In particular implementations, the signal combiners, both fixed and adjustable, may be incorporated into one physical unit to further the objective of providing frequency independent phase characteristics.

While there have been described the currently preferred embodiments of the invention, those skilled in the art will recognize that other and further modifications may be made without departing from the invention and it is intended to claim all modifications and variations as fall within the scope of the invention.

What is claimed is:

1. A GPS antenna system, comprising:

a vertically extending structure;

an array of primary radiator units supported by said structure at vertically spaced positions and each configured to provide an omnidirectional azimuth pattern;

an array of auxiliary radiator units supported by said structure each at a position adjacent to at least one of said primary radiator units and each configured to provide an omnidirectional azimuth pattern;

an excitation configuration coupled to each of said primary radiator units and to each of said auxiliary radiator units and arranged to provide at a first port a first signal formed by combining at predetermined relative signal levels signals received via said primary radiator units and at a second port a second signal formed by combining at predetermined relative signal levels signals received via said auxiliary radiator units; and an adjustable signal combiner coupled to said first and second ports and arranged to subtractively combine said first and second signals with relative signal levels, at least one of which is adjustable, to provide at an output port an output signal representative of an antenna pattern having a vertically-steerable null.

2. A GPS antenna system as in claim 1, additionally comprising:

an adaptive control system coupled to said output port, responsive to said output signal and arranged to implement adaptive processing techniques to provide a steering signal to said adjustable signal combiner to control adjustment of the signal level of at least one of said first and second signals to steer said vertically-steerable null.

3. A GPS antenna system as in claim 1, wherein said adjustable signal combiner is arranged to combine said first and second signals with the signal level of said second signal adjustable relative to said first signal.

4. A GPS antenna system as in claim 1, wherein said adjustable signal combiner is arranged to combine said first and second signals with relative phases which differ by 180 degrees to effect a subtraction of said second signal from said first signal.

5. A GPS antenna system as in claim 1, wherein said excitation configuration comprises a first signal combiner coupled to each of said primary radiator units and a second signal combiner coupled to each of said auxiliary radiator units.

6. A GPS antenna system as in claim 1, wherein each said radiator unit of each said array comprises a sub-array, of four dipoles positioned with different azimuth orientations, configured to provide an omnidirectional azimuth pattern.

7. A GPS antenna system as in claim 1, additionally comprising:

at least one indirectly excited radiator unit, of the same construction as one of said primary radiator units, supported by said structure adjacent to at least one of said primary and auxiliary radiator units, and not coupled to said excitation configuration.

8. A GPS antenna system as in claim 1, additionally comprising:

a primary/auxiliary radiator unit supported by said structure adjacent to at least one of said primary and auxiliary radiator units and configured to provide an omnidirectional azimuth pattern;

said excitation configuration additionally coupled to said primary/auxiliary radiator unit and arranged to provide at said first and second ports respective first and second signals each including, at respective predetermined signal levels, a portion of a signal received via said primary/auxiliary radiator unit.

9. A GPS antenna system as in claim 8, additionally comprising:

a signal divider coupled to said primary/auxiliary radiator unit and arranged to divide said signal received via the primary/auxiliary radiator unit to provide signal portions at said respective predetermined signal levels.

10. A GPS antenna system, usable to provide an antenna pattern having a vertically-steerable null, comprising:

a vertically extending structure;

an array of radiator units supported by said structure at vertically spaced positions and each configured to provide an omnidirectional azimuth pattern;

an excitation configuration coupled to each of said radiator units and arranged to provide at a first port a first signal formed by combining at predetermined relative signal levels signals received via a selected first plurality of said radiator units and at a second port a second signal formed by combining at predetermined relative signal levels signals received via a selected second plurality of said radiator units, said second plurality of radiator units including at least one radiator unit which is also included in said first plurality of radiator units; and an adjustable signal combiner coupled to said first and second ports and arranged to subtractively combine said first and second signals with relative signal levels, at least one of which is adjustable, to provide at an output port an output signal representative of an antenna pattern having a vertically-steerable null.

11. A GPS antenna system as in claim 10, wherein said excitation configuration is arranged with each radiator unit included in said first plurality of radiator units also included in said second plurality of radiator units, and with fewer than all radiator units of said second plurality of radiator units also included in said first plurality of radiator units.

12. A GPS antenna system as in claim 10 additionally comprising:

an adaptive control system coupled to said output port, responsive to said output signal and arranged to implement adaptive processing techniques to provide a steering signal to said adjustable signal combiner to control adjustment of the signal level of at least one of said first and second signals to steer said vertically-steerable null.

13. A GPS antenna system as in claim 10, wherein said adjustable signal combiner is arranged to combine said first and second signals with the signal level of said second signal adjustable relative to said first signal.

14. A GPS antenna system as in claim 10, wherein said adjustable signal combiner is arranged to combine said first and second signals with relative phases which differ by 180 degrees to effect a subtraction of said second signal from said first signal.

15. A GPS antenna system as in claim 10, wherein said excitation configuration includes a plurality of signal dividers, each coupled to at least one radiator unit which is included in both of said first and second pluralities of radiator units.

16. A method, usable to provide an antenna pattern having a vertically steerable null, comprising the steps of:

(a) providing a vertical array of radiator units each configured to provide an omnidirectional azimuth pattern;

(b) selecting a first plurality of said radiating units and a second plurality of said radiator units, one or more of which may be included in both of said first and second pluralities of radiator units;

(c) providing a first signal formed by combining at predetermined relative signal levels signals received via said first plurality of radiator units and a second signal formed by combining at predetermined relative signal levels signals received via said second plurality of radiator units; and (d) combining said first and second signals subtractively with relative signal levels, at least one of which is adjustable, to provide an output signal representative of an antenna pattern having a vertically-steerable null.

17. A method as in claim 16, additionally comprising the step of:

(e) implementing adaptive processing techniques responsive to said output signal to provide a steering signal to adjust the relative signal level of at least one of said first and second signals to steer said vertically-steerable null.

18. A method as in claim 16, wherein step (d) comprises combining said first and second signals with the signal level of said second signal adjustable relative to said first signal.

19. A method as in claim 16, wherein step (b) comprises selecting said first and second pluralities of radiator units with no radiator unit of said second plurality included in the first plurality of radiating units.

20. A method as in claim 16, wherein step (b) comprises selecting said first and second pluralities of radiator units with all radiator units of said first plurality also included in said second plurality of radiator units.

* * * * *

UNITED STATES PATENT AND TRADEMARK OFFICE
Certificate

Patent No. 7,417,597 B2 Patented: August 26, 2008

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Alfred R. Lopez, Commack, NY (US); and Raymond J. Lackey, Bohemia, NY (US).

Signed and Sealed this Sixteenth Day of April 2013.

JACOB Y. CHOI
*Supervisory Patent Examiner*
Art Unit 2821
Technology Center 2800